United States Patent [19]

Benham

[11] 4,401,257

[45] * Aug. 30, 1983

[54] MULTIPLE POCKET, EXPANDABLE ENVELOPE, AND BLANK AND METHOD FOR FORMING SAME

[75] Inventor: Albert A. Benham, Granville, Mass.

[73] Assignee: Champion International Corp., Stamford, Conn.

[ * ] Notice: The portion of the term of this patent subsequent to May 25, 1999 has been disclaimed.

[21] Appl. No.: 188,591

[22] Filed: Sep. 18, 1980

[51] Int. Cl.[3] ..... B65D 27/08

[52] U.S. Cl. ..... 229/72; 229/DIG. 3; 493/244; 493/246; 493/261; 493/267

[58] Field of Search ..... 229/72, DIG. 3, 56, 229/1.5 R; 493/244, 246, 261, 264, 267

[56] References Cited

U.S. PATENT DOCUMENTS

| | | | |
|---|---|---|---|
| 1,202,069 | 10/1916 | Kantro | 229/72 |
| 1,421,240 | 6/1922 | Ikeda et al. | 229/72 |
| 1,473,329 | 11/1923 | Williams | 229/72 |
| 1,586,016 | 5/1926 | Walters | 229/72 |
| 1,955,563 | 4/1934 | Rosenfeld | 229/72 |
| 2,108,343 | 2/1938 | McAllister | 229/68 R |
| 2,236,659 | 4/1941 | White | 229/72 |
| 2,416,816 | 3/1947 | Campagnano | 229/72 |
| 3,113,573 | 12/1963 | Schler | 229/68 R |
| 4,331,290 | 5/1982 | Benham | 229/72 |

*Primary Examiner*—Stephen P. Garbe

*Attorney, Agent, or Firm*—Evelyn M. Sommer; William W. Jones; John H. Mulholland

[57] ABSTRACT

A multiple pocket, expandable envelope is formed by folding panels of a planar, unitary blank relative to each other. The envelope has a front, a back, and a pair of intermediate panels hingedly coupled to each other along parallel end edges. A front divider panel is disposed between the front panel and one of the intermediate panels while a back divider panel is disposed between the back panel and the other of the intermediate panels to define four pockets within the envelope. The back panel is hingedly coupled to the back divider panel along a fold line at one side thereof. The one intermediate panel is hingedly coupled to the front divider panel along a fold line at one side thereof. A plurality of side panels hingedly couple the front panel to the front divider panel and the other intermediate panel to the back divider panel.

5 Claims, 10 Drawing Figures

MULTIPLE POCKET, EXPANDABLE ENVELOPE, AND BLANK AND METHOD FOR FORMING SAME

BACKGROUND OF THE INVENTION

The present invention relates to a multiple pocket, expandable envelope, a blank for forming a multiple pocket, expandable envelope, and a method of forming a multiple pocket, expandable envelope from a blank. More particularly, the invention relates to the use of a planar, unitary blank for forming a multiple pocket, expandable envelope which may be folded simply and inexpensively in a one pass, right angle gluing and folding operation.

In constructing envelopes or folders, it is often necessary to provide a plurality of individual pockets or compartments for separating the contents of the envelope. Additionally, the envelope must be capable of being shipped and stored in a flat, collapsed configuration to use shipping and storage space efficiently, and then expanded to receive varying amounts of contents, e.g., sheets of paper.

Conventional multiple pocket envelopes or folders are formed from a plurality of components which are automatically and manually assembled. The forming of such envelopes from a plurality of components is difficult and expensive, involving both manual steps and complex machinery.

To form multiple pocket, expandable envelopes simply, inexpensively and efficiently, such envelopes must be formed from a planar, unitary blank which may be folded and glued in one pass, right angle gluing and folding operation. Such operation eliminates manual handling and permits the envelope to be manufactured on relatively simple, conventional folding and gluing apparatus.

SUMMARY OF THE INVENTION

Accordingly, it is an object of the present invention to provide a multiple pocket, expandable envelope, and blank and method for forming same employing a planar unitary blank which may be simply and inexpensively formed in a one pass, right angle gluing and folding operation on conventional folding and gluing apparatus.

Another object of the present invention is to provide a multiple pocket, expandable envelope which is of rugged construction and is easily adapted to various shapes and sizes and different numbers of pockets.

The foregoing objects are attained by providing a multiple pocket, expandable envelope formed from a planar, unitary blank, comprising a front panel, a pair of intermediate panels and a back panel having opposed end edges and opposed first and second side edges. The panels are hingedly coupled at adjacent end edges thereof along a fold line. Front and back divider panels each having opposed first and second side edges and opposed first and second surfaces are also provided. The front and back divider panels are hingedly coupled at the first side edge thereof to one of the intermediate panels and back panel, respectively, at the first side edges thereof along fold lines. First expansion means hingedly couple the front panel at its opposite side edges thereof to the front divider panel, and second expansion means hingedly couple the back divider panel to one of the intermediate panels and back panel to form a four pocket expandable envelope. The expansion means comprise side panels hingedly coupled along a fold line to the opposed first and second side edges of the other of the intermediate panels and the front panel and the second side edge of the back panel and one intermediate panel.

The blank is folded to form the envelope of the invention by first folding each of the side panels to overlie the interior surfaces of each of the panels to which it is connected, respectively, about the respective fold lines therebetween. Each divider panel is then folded about the fold line connecting it to the first side edge of the back panel and one intermediate panel, respectively, to overlie the interior surface of that panel and the side panel connected to the opposite or second side edge thereof. Each divider panel is then adhesively connected to the underneath side panel. The front panel and one intermediate panel are then folded about their common end edge so that the interior surfaces thereof face each other, and the side panels overlying the front panel are adhesively connected to spaced portions of the front divider panel inwardly of its side edges. Similarly, the back panel and other intermediate panel are then folded about their common end edge so that the interior surfaces thereof face each other, and the side panels overlying the other intermediate panel are adhesively connected to spaced portions of the back divider panel inwardly of its side edges. The back and front panels are then folded 180 degrees relative to each other about the common end edge hingedly connecting the intermediate panels to present four expandable pockets.

A cover flap may also be provided hingedly coupled along an end edge of the back panel which may be folded 180 degrees relative to the back panel over the front panel. The adhesively connected side panels and divider panels enable ready expansion of the envelope in a direction extending from the back to the front panel.

By forming the envelope and blank and by performing the method of the present invention in this manner, a multiple pocket, expandable envelope may be simply and inexpensively formed from a planar, unitary blank in a one pass, right angle folding and gluing operation. This permits the envelope to be formed automatically without manual handling on conventional right angle folding and gluing apparatus. Thereby, the problems associated with forming conventional multiple pocket envelopes comprising many separate components are eliminated.

Other objects, advantages and salient features of the present invention will become apparent from the following detailed description, which taken in conjunction with the annexed drawings, discloses a preferred embodiment of the present invention.

As used in this application, the terms "first", "second", "front", "back", "side", "end", "interior" and "exterior" are intended to facilitate the description of the envelope and the blank for forming the envelope. Thus, such terms are merely illustrative of the envelope and blank and are not intended to limit the envelope or blank to any specific orientation.

BRIEF DESCRIPTION OF THE DRAWINGS

Further objects and advantages of the invention will become apparent from the following description and claims and from the accompanying drawings, wherein:

DETAILED DESCRIPTION OF THE PREFERRED EMBODIMENT

Figure 1:
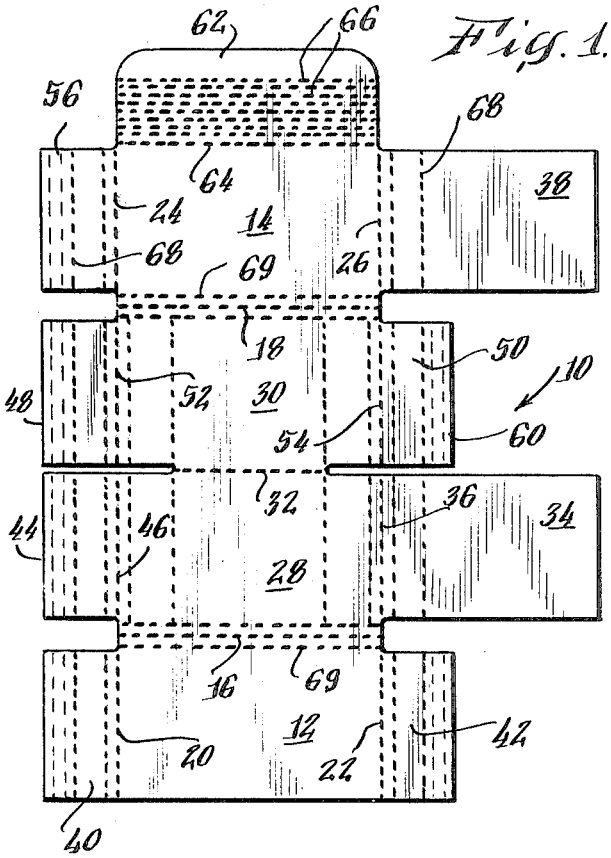
FIG. 1 is a plan view illustrating a blank for forming an envelope in accordance with the present invention.
Figure 2:
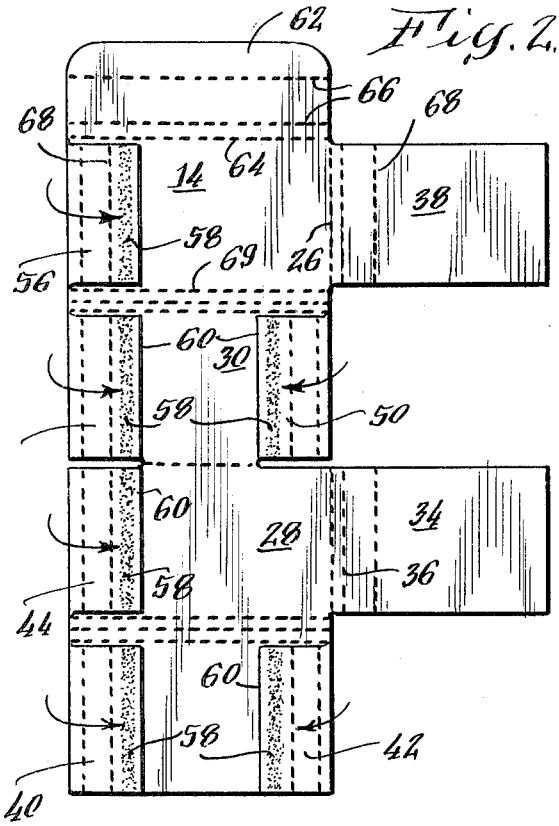
FIGS. 2, 3, 4 and 6 are views illustrating the blank of FIG. 1 in various stages of assembly.
Figure 3:
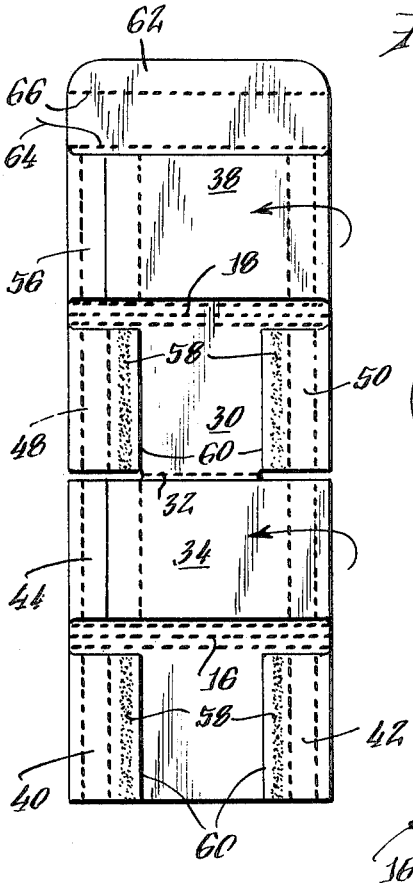
Figure 4:
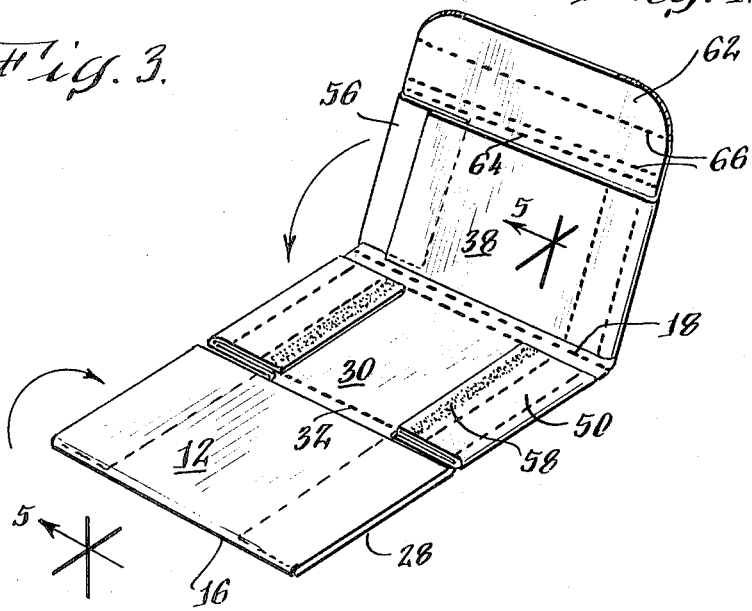
Figure 5:
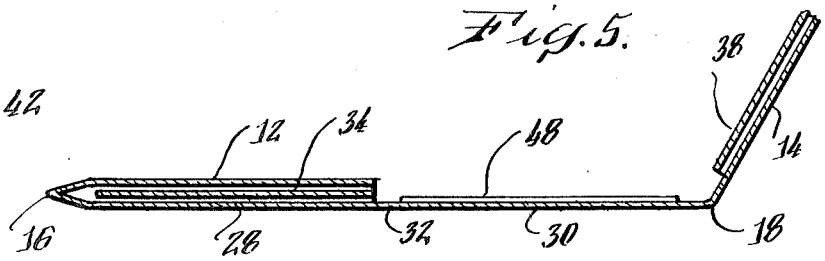
FIGS. 5 and 7 are cross-sectional views, respectively, of the blank taken along the planes indicated by lines 5—5 and 7—7 in FIGS. 4 and 6, respectively.
Figure 6:
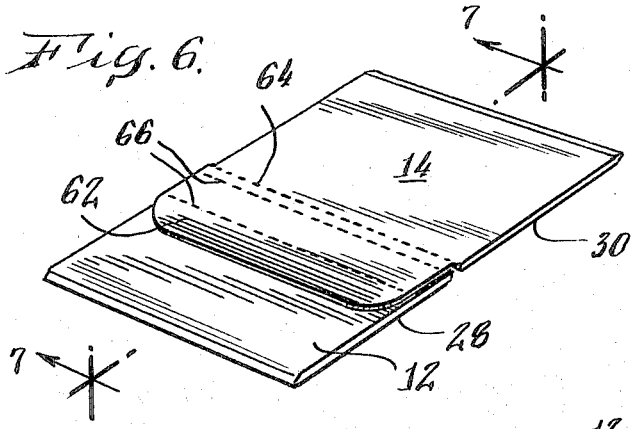
Figure 7:
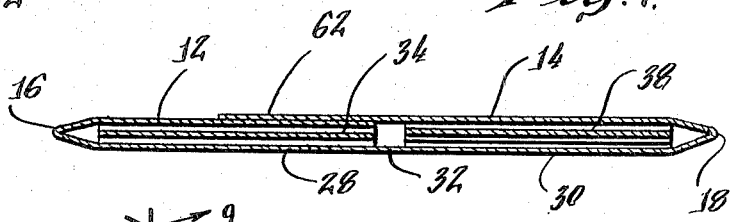

Referring to FIG. 1, the blank 10 may be formed of a planar, unitary piece of paperboard of suitable weight and thickness. The weight and thickness of the paper depends on the size of the envelope or folder to be formed and the weight of the article to be placed within the envelope.

The blank 10 includes a front panel 12 and a back panel 14 generally rectangular in shape and equal in size; however, it should be noted that such panels may be of any suitable configuration and relative size. Each of the front and back panels 12, 14 has an end edge 16, 18, respectively, which extends horizontally across the paper in FIG. 1 and opposed first and second side edges 20, 22 and 24, 26, respectively, which extend vertically in FIG. 1. The front panel 14 is hingedly coupled along adjacent end edge 16 thereof to a first intermediate panel 28. The back panel 14 is hingedly coupled along adjacent end edge 18 to a second intermediate panel 30. Intermediate panels 28, 30 are hingedly coupled along a common end edge 32. Panels 28 and 30 are also generally rectangular in shape and equal size to each other and the front and back panels 12 and 14.

A front divider panel 34 extends from one side edge 36 of the intermediate panel 28 and is hingedly coupled thereto. The front divider panel 34 is generally rectangular in shape and smaller in size than the intermediate panel 28. However, the panel 34 may be of any suitable configuration and size.

A back divider panel 38 extends from the side edge 26 of back panel 14 and is hingedly coupled thereto. The back divider panel 38 is generally rectangular in shape and smaller in size than the back panel 14. However, panel 38 may be of any suitable configuration and size.

Front side panels 40, 42 extend laterally from the front panel 12. The first front side panel 40 is hingedly coupled to the side edge 20 of the front panel 12. The second front side panel 42 is hingedly coupled to the opposite side edge 22 of the front panel 12. The side panels 40, 42 are generally rectangular in configuration. An intermediate side panel 44, generally rectangular in configuration, extends laterally from the side edge 46 of first intermediate panel 28. Intermediate side panels 48, 50 are foldably connected along side edges 52, 54, respectively, to the second intermediate panel 30. Side panels 48 and 50 are also generally rectangular in configuration and of the same size as side flaps 40, 42 and 44. A side flap 56, of the same size and configuration as the other side flaps is hingedly connected to side edge 24 of back panel 14. The opposite or exterior surfaces of each of the side flaps includes a glue area 58 along its outer free edge 60, spaced from the corresponding side edge of the back, front, first or second intermediate panel.

The top flap 62 of generally rectangular configuration is hingedly coupled to the end edge 64 of the back panel 14 remote from the second intermediate panel 30. The top flap 62 includes a series of parallel score or fold lines 66 to facilitate folding of the top flap 62 at various expanded extents of the envelope. This is also true of the side panels 40, 42, 44, 48, 50 and 56, as well as front and back divider panels 34 and 38 which include additional spaced score or fold lines 68, parallel to the respective adjacent side edges 20, 22, 36, 46, 52, 54, 24 and 26, to facilitate expansion of the envelope 70 of the invention from back panel 14 to front panel 12. Score lines 69 are also provided on opposite sides and parallel to end edges 16 and 18 to facilitate expansion between panels 12 and 28 and panels 14 and 30.

Figure 8:
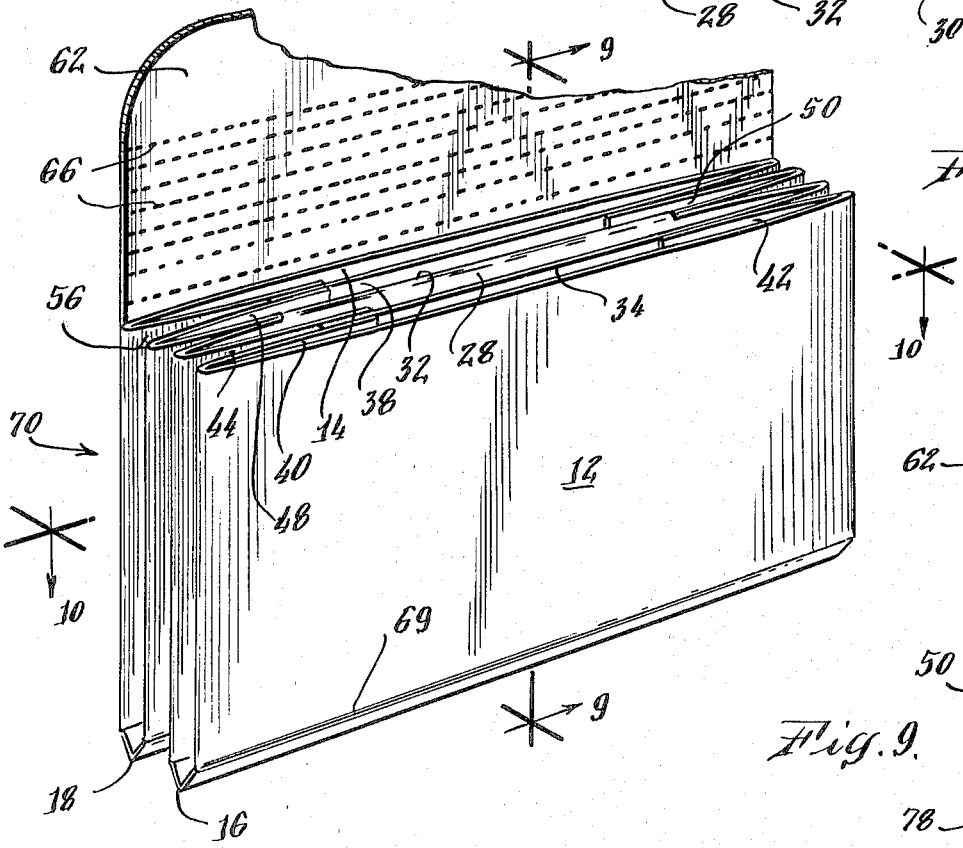
FIG. 8 is a perspective view of the envelope of the present invention formed from the blank of FIG. 1.
Figure 9:
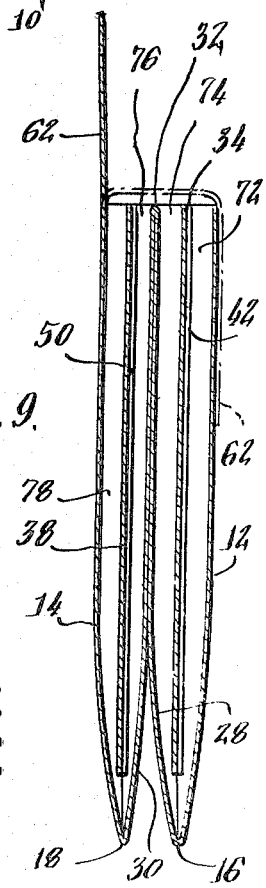
FIG. 9 is a cross-sectional view taken substantially along the plane indicated by line 9—9 of FIG. 8.
Figure 10:
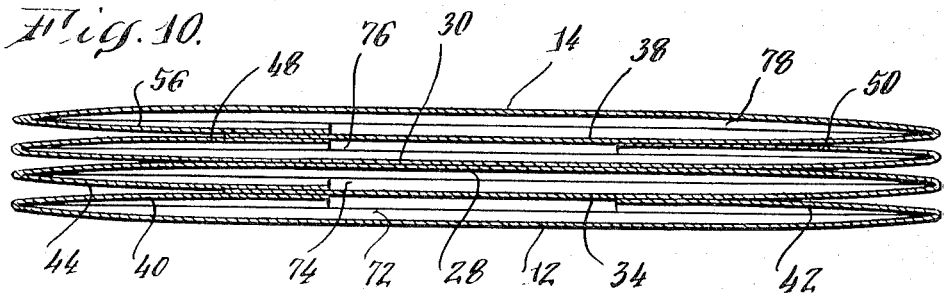
FIG. 10 is a cross-sectional view taken substantially along the plane indicated by line 10—10 of FIG. 8.

The envelope 70 (illustrated in FIGS. 8 to 10) is formed from the blank 10 of FIG. 1 as illustrated in FIGS. 1 to 7 by first folding each of the side panels to overlie the interior surfaces of each of the panels to which it is connected, respectively, about the respective fold lines therebetween. (See FIG. 2). Each divider panel 38, 34 is then folded about the fold line connecting it to the first side edge 26 of the back panel 14 and the first side edge 36 of one intermediate panel 28, respectively, to overlie the interior surface of that panel and the side panel 56, 44, respectively, connected to the opposite or second side edge 24, 46, respectively, thereof. Each divider panel 38, 34 is then adhesively connected to the underneath side panel along glue area 58. (See FIG. 3). The front panel 12 and one intermediate panel 28, are then folded about their common end edge 16 so that the interior surfaces thereof face each other, and the side panels 40, 42 overlying the front panel 12 are adhesively connected along their glue areas 58 to spaced portions of the front divider panel 34 inwardly of its side edges. Similarly, the back panel 14 and other intermediate panel 30 are then folded about their common end edges 18 so that the interior surfaces thereof face each other, and the side panels 48, 50 overlying the other intermediate panel 30 are adhesively connected to spaced portions of the back divider panel along its glue areas 58 inwardly of its side edges. (See FIGS. 4 to 7). The back and front panels 14, 12, respectively, are then folded 180 degrees relative to each other about the common end edge 32 hingedly connecting the intermediate panels 28, 30 to provide four expandable pockets 72, 74, 76 and 78 in an envelope 70 (FIGS. 8 to 10). The cover flap 62 hingedly coupled along an end edge 64 of the back panel 14 may be folded 180 degrees relative to the back panel 14 over the front panel 12. The adhesively connected side panels and divider panels enable ready expansion of the envelope in a direction extending from the back to the front panels, with score lines 68 and 69 aiding in the expansible extension.

In the open and expanded configuration of the envelope 70 illustrated in FIGS. 8 to 10, the envelope 70 has four pockets 72, 74, 76 and 78. The front pocket 72 is defined between the front panel 12 and the front divider panel 34. A middle pocket 74 is defined between the divider panels 34 and intermediate panel 28. Another middle pocket 76 is provided between intermediate panel 30 and back divider panel 38. The back pocket 76 is defined between the back panel 14 and the back divider panel 38.

The expandable nature of the envelope 80 is provided by the arrangement of the side panels and divider panels, together with the hinged couplings of the front, back and intermediate panels along with the additional score lines 68 and 69.

What is claimed as new is:

1. A multiple pocket, expandable envelope formed from a planar, unitary blank, comprising:

a front, a back, and a first and a second intermediate panel between said front and back panels, each of said panels having opposed end edges and opposed side edges, said intermediate panels being hingedly coupled along a common end edge thereof while said first intermediate panel is hingedly coupled to said front panel along a common end edge and said second intermediate panel is hingedly coupled to said back panel along a common end edge, front and back divider panels each having opposed side edges, said front divider panel being hingedly coupled at one side edge thereof to one of said first intermediate and front panels, and said back divider panel being hingedly coupled at one side edge thereof to one of said second intermediate and back panels;

first means hingedly coupling said one side edge of said front divider panel to the other of said first intermediate panel and said front panel;

second means hingedly coupling the other side edge of said front divider panel to said front panel;

third means hingedly coupling the other side edge of said front divider panel to said first intermediate panel;

fourth means hingedly coupling said one side edge of said back divider panel to the other of said second intermediate panel and said back panel;

fifth means hingedly coupling the other side edge of said back divider panel to said second intermediate panel; and sixth means hingedly coupling the other side edge of said back divider panel to said back panel.

2. A planar, unitary blank for forming a multiple pocket, expandable envelope, comprising:

front and back panels each having opposed end edges and opposed first and second side edges;

a pair of intermediate panels each having opposed end edges and opposed first and second side edges; said intermediate panels being hingedly coupled to each other along a common end edge, and one of said intermediate panels being hingedly coupled to said back panel along a common end edge while the other intermediate panel is hingedly coupled to said front panel along a common end edge;

a front divider panel hingedly coupled to one of said other intermediate panel and said front panel at a side edge thereof along a fold line;

first and second side panels hingedly coupled to the opposed first and second side edges of the other of said front panel and said other intermediate panel respectively, along fold lines;

a back divider panel hingedly coupled to one of said one intermediate panel and said back panel at a side edge along a fold line; and first and second back side panels hingedly coupled to side edges of the other of said one intermediate panel and said back panel and at the other of said back panel side edges, respectively, along fold lines.

3. A blank according to claim 2 including a top closure flap hingedly coupled along a common end edge to said back panel.

4. A blank according to claim 2, wherein said first side edges are colinear and said second side edges are colinear.

5. A method of forming a multiple pocket, expandable envelope, comprising:

forming a planar, unitary blank with front and back panels each having opposed end edges and opposed first and second side edges;

a pair of intermediate panels each having opposed end edges and opposed first and second side edges; said intermediate panels being hingedly coupled to each other along a common end edge, and one of said intermediate panels being hingedly coupled to said back panel along a common end edge while the other intermediate panel is hingedly coupled to said front panel along a common end edge;

a front divider panel hingedly coupled at one of said other intermediate panel side edges along a fold line;

first and second side panels hingedly coupled to the opposed first and second side edges of said front panel and at a side edge of said other intermediate panel respectively, along fold lines;

a back divider panel hingedly coupled at one of said back panel side edges along a fold line; and first and second back side panels hingedly coupled at a side edge of said one intermediate panel and at the other of said back panel side edges, respectively, along fold lines;

folding said first front side panels, said one intermediate side panels and said second back side panel an other intermediate side panel to overlie interior surfaces of their respective panels about the respective fold lines therebetween;

folding said front and back divider panels to overlie said other intermediate panel and its side panel and said back side panel and said back panel, respectively, about the respective fold lines therebetween, and fixing said other intermediate side panel and said back side panel to adjacent surfaces of said front and back divider panels, respectively;

folding said front panel and other intermediate panel relative to each other along a common end edge and said back and one intermediate panels relative to each other along a common end edge.

* * * * *